US007626122B2

(12) United States Patent
Levine

(10) Patent No.: US 7,626,122 B2
(45) Date of Patent: Dec. 1, 2009

(54) LIGHTWEIGHT COMPOSITE ELECTRICAL WIRE

(76) Inventor: David Levine, 696 E. 182nd St., Apt. 1, Bronx, NY (US) 10457

( * ) Notice: Subject to any disclaimer, the term of this patent is extended or adjusted under 35 U.S.C. 154(b) by 0 days.

(21) Appl. No.: 11/845,716

(22) Filed: Aug. 27, 2007

(65) Prior Publication Data

US 2008/0047736 A1 Feb. 28, 2008

Related U.S. Application Data

(60) Provisional application No. 60/840,173, filed on Aug. 25, 2006.

(51) Int. Cl.
*H01B 5/00* (2006.01)

(52) U.S. Cl. ..... 174/126.1

(58) Field of Classification Search ..... 174/126.1, 174/DIG. 7, 126.2, 125.1
See application file for complete search history.

(56) References Cited

U.S. PATENT DOCUMENTS

| | | | | |
|---|---|---|---|---|
| 1,915,788 | A | 6/1933 | Hardy | |
| 3,333,049 | A | 7/1967 | Humphrey | |
| 3,349,832 | A | 10/1967 | Crowdes | |
| 3,389,460 | A | 6/1968 | Rubinstein | |
| 3,421,569 | A | 1/1969 | Neumann | |
| 3,461,943 | A | 8/1969 | Schile | |
| 3,521,849 | A | 7/1970 | Voss | |
| 3,543,831 | A | 12/1970 | Schile | |
| 3,584,678 | A | 6/1971 | Rakestraw | |
| 3,613,158 | A | 10/1971 | Mottern | |
| 3,649,745 | A | 3/1972 | Volk | |
| 3,658,979 | A | 4/1972 | Dunn | |
| 3,692,089 | A | 9/1972 | Privott, Jr. | |
| 3,717,929 | A | 2/1973 | Atkinson | |
| 3,750,741 | A | 8/1973 | Rakestraw | |
| 3,771,982 | A | 11/1973 | Dobo | |
| 3,811,850 | A | 5/1974 | Dobo | |
| 3,853,171 | A | 12/1974 | Junker | |
| 3,854,518 | A | 12/1974 | Junker | |
| 3,854,519 | A | 12/1974 | Junker | |
| 3,889,739 | A | 6/1975 | Rakestraw | |
| 3,904,381 | A | 9/1975 | Dobo | |
| 4,056,679 | A | 11/1977 | Brandt | |
| 4,080,222 | A | 3/1978 | Schoerner | |
| 4,178,985 | A | 12/1979 | Sauvage | |
| 4,370,114 | A | 1/1983 | Okamoto | |
| 5,057,651 | A | 10/1991 | Hope | |
| 6,246,008 | B1 * | 6/2001 | Fluckiger et al. | 174/126.1 |
| 6,463,995 | B1 | 10/2002 | Lehman | |

* cited by examiner

*Primary Examiner*—Chau N Nguyen
(74) *Attorney, Agent, or Firm*—Christensen O'Connor Johnson Kindness PLLC

(57) ABSTRACT

A lightweight composite electrical wire having a fusible core encased or enclosed by a conductive wall. In embodiments the core is sodium, and the wall is aluminum. In another embodiment the wall is a curved bimetallic wall having a first wall component having a high CTE and a second wall component having a low CTE such that changes in temperature will generate stresses that tend to change the shape of the wall, wherein a break in a heated wire will cause retraction of the core. Transverse bulkheads separate the core longitudinally, precluding or mitigating any loss of core material in accident scenarios, and providing locations for cutting and connecting the conductor. The bulkheads may include indentations. A insulative outer layer is provided. A novel outer layer construction utilizes fusible materials to provide insulation in accident scenarios.

15 Claims, 7 Drawing Sheets

LIGHTWEIGHT COMPOSITE ELECTRICAL WIRE

CROSS-REFERENCE TO RELATED APPLICATION

This application claims the benefit of U.S. Provisional Application No. 60/840,173, filed Aug. 25, 2006, the disclosure of which is hereby expressly incorporated by reference in its entirety, and priority from the filing date of which is hereby claimed under 35 U.S.C. § 119.

BACKGROUND

This invention relates to the field of conductors and methods of manufacturing conductors, especially with regards to lightweight composite electrical wires.

In many applications, the weight of an electrical conductor is not an issue. Rather, cost, conductivity, flexibility and longevity are primary considerations. Copper has been the obvious choice for many applications because of its availability, ductility, moderately low cost, and high conductivity.

During the 20th century, alternative conductors were developed for special applications. Examples include semiconductors for integrated circuits, superconductors for powerful electromagnets, and aluminum for utility power transmission. Aluminum wire also had brief widespread use for general wiring. However, this ended following numerous house fires that were attributed to inadequately designed electrical terminations. Interestingly, there is little evidence of fire caused by the copper-clad variety of aluminum wire, which is still in use in many installations. Nonetheless, designers are presently reluctant to use any non-cuprous wire that is not definitely proven to be safe, and rightly so. The vast majority of electrical wiring remains copper or some alloy thereof, even in aerospace applications where a premium is gladly paid to reduce weight.

It is commonly believed that copper and silver are the "best" room temperature conductors. However, many fail to realize the arbitrary historical basis of this supposed superiority. Conductivity has conventionally been defined as a measure of the ability of a unit volume of a material to conduct electricity. Another useful definition, however, would characterize the ability of a unit mass to conduct electricity. When conductivity was first defined, the distinction between the volume and mass of a conductor was irrelevant because it was rarely important to reduce the weight of electrical wire. Over the years, however, machines have become increasingly mobile, energy prices have increased, and reduction of weight has assumed far greater importance.

Density adjusted conductivity is a measure of conductivity per unit mass, and is easily calculated by dividing conventional conductivity by mass density. Density adjusted conductivity is a more useful figure of merit for comparing different types of conductors for possible use in applications where electrical conduction with minimal weight is desired.

Sodium, for example, has roughly one-third the conductivity of copper but approximately one-ninth the density. Thus, the density adjusted conductivity of sodium is approximately three times that of copper. Were one to replace a copper wire with an equivalent length of sodium wire having three times the cross-sectional area, the thicker sodium wire would have the same conductance as the copper, but would weigh only one-third as much. Hence, per unit mass, sodium conducts constant current at least three times better than copper.

A century ago, most conductors carried constant current for long periods of time through insulators with low maximum service temperature, primarily for such uses as electrical lighting and motors. Today, however, many conductors carry brief pulses of electricity separated by relatively long idle periods. Also, modern insulators are often capable of withstanding very high temperatures. An extremely lightweight wire that tolerates intense current, if only for a brief period of time, is of much greater usefulness today than a century ago.

Most wire continues to be sized on the traditional basis of continuous operation, where heat generation from electrical resistance is in thermodynamic equilibrium with the rate of heat rejection from the wire into the environment. However, today most electrical conductors operate in thermal disequilibrium. During a brief pulse, the wire is heated much faster than it is cooled. Later, when no longer conducting electricity, most of the resistive heat from the wire is released to the environment. A wire's "impulse tolerance" (number of ampere seconds of brief impulse a unit mass of wire can repeatedly tolerate) is often a more useful measure of a wire's suitability to an application than the number of amperes the wire would tolerate if operated continuously.

Based on the more useful criteria of density adjusted conductivity and impulse tolerance, which conductive elements are best? Surprisingly, not silver and copper but rather the lightweight alkali metals sodium and lithium, which both have more than three times the density adjusted conductivity as copper, and, under common conditions, on the order of one thousand times the impulse tolerance.

Factors Affecting Impulse Tolerance

The impulse tolerance of non-superconducting wire is largely dependent on a wire's ability to tolerate resistive heat produced during an impulse, which is a composite function of electro-thermodynamic performance at each of several stages that largely occur in chronological succession: resistive heat production in solid metal, temperature increase, possible melting, continued resistive heat production in liquid metal, cessation of impulse, transfer of heat to the environment, possible refreezing, and cooling back to ambient temperature. Performance at each stage depends on different material properties. The best conductor would perform well during all of these stages.

For a given amount of current, the heat produced per unit mass is inversely proportional to the density adjusted conductivity of the solid metal. During a brief impulse, almost all of the heat that is produced stays in a wire, increasing its temperature. Increased temperature decreases conductivity, and if high enough, damages a wire or adjacent components. The temperature increase of a wire per unit mass per given amount of resistive heating is inversely proportional to the wire's specific heat. If the temperature of a wire is high enough to melt the wire, then heat is absorbed by the process of melting.

The amount of heat absorbed during melting is proportional to the wire's heat of fusion. Once melted, the rate of resistive heat production is inversely proportional to the density adjusted conductivity of the liquid metal.

After an impulse is finished, the rate of heat rejection per unit mass depends on several parameters.

Why Sodium and Lithium Wire have Superior Impulse Tolerance

At every step of the process of impulse conduction, the material properties of lithium and sodium cause them to outperform all other metal elements. As discussed above, sodium and lithium have the highest density adjusted conductivity of all the elements. Thus, they generate the least amount of heat per unit mass when conducting electricity. They have very high specific heat, so the resistive heat that is produced increases the temperature of the metals relatively little.

Conductors are usually thought of as solid material. Melting of a conductor is commonly considered synonymous with structural failure, and occurring at an unacceptably high temperature is likely to cause fire. However, sodium's and lithium's surprisingly low melting points (97.7° C. and 180.5° C., respectively) are entirely compatible with maximum service temperatures present in many applications. Not only is melting thermally tolerable by most adjacent components, it is surprisingly advantageous, as both metals have a high heat of fusion that provides absorption of a tremendous amount of heat per unit mass during melting.

Both sodium and lithium have high volume per unit mass, thus high surface area per unit mass, which aids heat transfer. If melted, heat transfer is further aided by the temperature of the wire not falling below the melting point during most of the cooling process as the molten metal refreezes. The temperature difference between the wire and its environment is thereby held at a relatively high level throughout most of the cooling process. By adding a small amount of lithium to sodium, the melting point may be increased to just under the maximum service temperature of surrounding components, maximizing the temperature gradient and resultant heat transfer. Compared to denser, continuously solid conductors whose rate of cooling immediately starts decreasing with decreasing temperature during cooling, permissibly fusible sodium and lithium conductors lose heat more quickly, thereby tolerating greater and more frequent impulses. Both sodium and lithium lose some conductivity as they melt, as do all metals. However, even when completely melted, sodium and lithium continue to have surprisingly high mass adjusted conductivity. Even at 200° C., the density adjusted conductivity of sodium is surprisingly still better than 200° C. solid copper. (200° C. molten lithium has density adjusted conductivity only slightly worse than 200° C. solid copper).

The low melting point, high heat of fusion, low mass density and comparatively small increase in heat-producing resistivity when melted combine to prevent the temperature of a permissibly fusible sodium or lithium conductor from ever exceeding its melting point under a wide range of operational conditions. This represents a surprising benefit of "intrinsic thermal control" not usually associated with conductive metals.

Copper for example has little intrinsic thermal control. Due to its low specific heat, the temperature of a piece of copper wire increases rapidly in response to resistive heating. In fact, this effect is so pronounced that the size of most copper wire is chosen primarily by the maximum permissible wire temperature rather than the optimal trade-off between wire mass and resistive energy loss. Potential economies from more resistive but lighter copper wire are lost because the wire temperature would unsafely exceed thermal limits.

To maximize heat flow out of an alkali metal wire, the melting point may be adjusted to just under the maximum service temperature of adjacent components by choosing an alkali metal alloy that has the desired melting point. A designer may then choose the size of an alkali metal alloy conductor by balancing the weight penalty of a larger wire with the electrical cost penalty from the increased resistance of a smaller wire. The minimum size possible is that which is just sufficient to tolerate the maximum expected impulse by completely melting and rising to the maximum service temperature of adjacent components. A copper wire of the same weight, when exposed to the same impulse, would not only generate more than three times the total heat, but would also exhibit a spike in temperature that would greatly exceed the thermal tolerance of surrounding components.

Electro-thermodynamic calculations show a sodium or lithium conductor designed to completely melt can handle on the order of 1000 times the electrical impulse as a non-meltable copper wire of equivalent mass heated to the same temperature. Thus, a copper wire designed to barely tolerate a given magnitude of impulse can potentially be replaced with a fusible lithium or sodium wire weighing only one thousandth as much.

Sodium in particular has numerous characteristics that recommend its use as an electrical conductor. Made from ordinary salt, it is limitlessly available and very inexpensive, especially compared to copper. It has heat of fusion second only to lithium, excellent intrinsic thermal control at a convenient melting point of 97.7° C., retains about half its conductivity when melted, cools quickly due to high surface to mass ratio, has impulse tolerance second only to lithium and has the highest density adjusted conductivity at room temperature of any material known to man.

Problems with Alkali Metal Conductors

The excellent electro-thermodynamic properties of lithium and sodium, however, come with a number of very inconvenient chemical and physical properties that have heretofore made them impractical for widespread use. They react strongly with almost all materials when heated, especially when melted. They ignite easily not only in oxygen, but most other common gaseous environments. Sodium burns just below its 883° C. boiling point, emitting caustic fumes onto surrounding structures. If sodium or lithium is doused with water, hot explosive hydrogen gas is generated. In fact, all common fire extinguishing agents actually exacerbate alkali metal fires.

Neither sodium nor lithium is pyrophoric, i.e. exposure of solid sodium or lithium to air does not spontaneously produce fire. However, they do rapidly oxidize into caustic and non-conductive material that may corrode adjacent components.

Because alkali metals are extremely reactive and have low tensile strength, they are of no practical use unless encased in a protective and reinforcing casing. Containment is complicated by alkali metals' extremely high coefficient of thermal expansion. Sodium in particular has the highest thermal coefficient of expansion of all metallic elements. Refractory containment materials are generally heavy, have comparatively low coefficients of thermal expansion and have limited elastic range which limits bendability. Flexible polymer containment may allow wire thinning from stretching that produces hot spots from increased current density. Water vapor penetrating through polymer produces destructive hydrogen gas and sodium hydroxide. Most importantly, containment with polymer adds weight without directly adding any electrical conductance, unlike the case of metallic containment where weight penalty is partially overcome by electrical conduction through the container's wall.

Inventors have been trying for more than a century to enjoy various electro-thermodynamic and economic advantages of alkali metal conductors without suffering the chemical and physical problems described above. Limited success in a few circumscribed applications has heretofore not extended to widespread commercial acceptance for a variety of practical reasons, including but not limited to: flammability, lack of a practical means of safe wire termination, excessive weight, unreliable protection from external reactive environment, prohibitively expensive means of manufacture, inadequate flexibility, and lack of means to easily cut the wire to any desired length without special tools or knowledge.

It is the purpose of the present invention to provide a practical conductor that exploits the potential advantages of alkali metal conductors while overcoming the limitations of prior art to provide a lightweight, safe, reliable, flexible, easily connected, electro-thermo-dynamically superior, easily customizable and less expensive alternative to copper wire suitable for most wiring applications.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

A lightweight composite electrical wire is disclosed having a fusible, electrically conductive core disposed in an electrically conductive wall portion. The wire is designed such that the core will melt and refreeze during normal operation, in response to varying loads carried by the conductor. The conductive core may be formed, for example from an alkali metal such as sodium or an alloy of sodium, and the outer wall may be formed from a conventional conductor such as aluminum or the like.

In a current embodiment the fusible core is longitudinally interrupted by transverse bulkheads, which may be co-formed with the core and wall, and that divide the core into a plurality of core cells. An intermediate layer such as copper, lithium, molybdenum or the like may be disposed between the core cells and the conductive wall.

In a particular embodiment, the thickness of the wire is reduced at the bulkheads, for example by defining a notch or the like at the bulkheads. The reduced thickness provides a visual and/or tactile indicator of the bulkhead location, and preferably makes the wire weaker at the bulkheads such that the wire will preferentially break at such bulkheads.

In a particular embodiment, the walls are composite walls that define a re-entrant structure, such that in the event of a break the fusible core will tend to be withdrawn into channels in the wall.

In a particular embodiment, an outer insulating layer is provided, that defines channels between the outer layer and the conductive wall. The channels may be filled with one or more fusible materials, that provide additional protection.

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION

A lightweight, composite electric wire is disclosed, having a core comprising an alkali metal enclosed by an outer conductive wall. Preferably, the core portion of the wire is periodically interrupted or divided into relatively short lengths by bulkheads. In disclosed embodiments, the wire is configured to prevent or mitigate the exposure of the alkali metal core even in accident scenarios.

Figure 1:
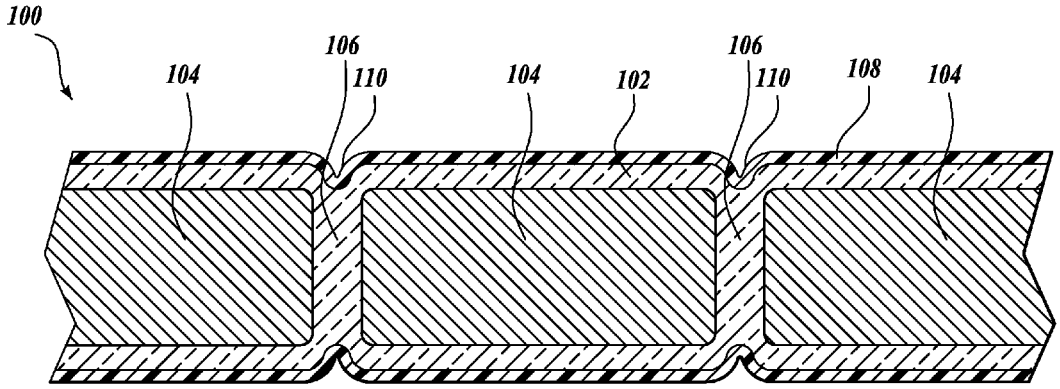
FIG. 1 is a longitudinal cross-sectional side view of a short length of wire made in accordance with a first embodiment of the present invention (for clarity, the FIGURES are not to scale)

FIG. 1 shows a cross-sectional side view of a portion of a wire 100 in accordance with the present invention. For clarity in identifying and explaining various aspects of the wire 100, the drawings are not drawn to scale. The wire 100 includes a generally tubular conductive wall 102 having a fusible core 104. The conductive wall 102 may be made from, for example, aluminum, copper, or alloys thereof. The fusible core 104 preferably comprises an alkali metal, preferably sodium, lithium or alloys thereof. The wire 100 includes a plurality of intermittent transverse bulkheads 106 that separate the fusible core 104 into a plurality of relatively short sections. An insulating layer 108 may also be provided over the conductive wall 102.

As discussed in more detail below, the fusible core 104 may melt due to heating from current carried by the wire 100, and the fusible core 104 may refreeze or solidify when the current is reduced or absent. In operation, portions of the wire 100 may repeatedly melt and refreeze, in response to a varying electrical load. The wire 100, comprising the conductive wall 102 and core 104, may be classified as a bimetallic composite conductor. If the inner diameter of the cell comprised of the conductive wall 102 is less than about one millimeter, the wire 100 may be classified as a binary linear cellular alloy ("LCA").

An LCA such as wire 100 typically has a higher conductivity than a corresponding conventional alloy made with the same elemental composition. The improved conductivity is believed to result from the different metals being electrically in parallel with each other along the length of the wire 100. Therefore, in the wire 100 the more electrically resistive of the two metals will not spoil the conductivity of the less electrically resistive metal.

Also, the wire 100 has anisotropic tensile strength, favorably biased along the longitudinal axis of wire 100. The physical integrity of the stronger metallic component in the longitudinal direction is not spoiled by intervening weak links made of the weaker metal.

Although the wire 100 may be produced using a variety of different metal pairs, only a limited number of immiscible metal pairs have electro-thermodynamic properties that will result in a wire significantly superior to conventional copper wire. For example, an aluminum wall 102 with a sodium core 104 provides an economical and useful pairing, suitable for operation in wire temperatures of up to about 350° C. A copper wall 102 and sodium core 104 may be used at temperatures up to about 400° C., without significant corrosion. Lithium and copper form another highly conductive binary LCA that has similar specific conductivity and higher impulse tolerance to a similar aluminum/sodium wire, but at a greater cost and at operational temperature of up to only about 300° C. Lithium and aluminum may form an excellent pair if a protective layer is provided to keep the lithium and aluminum from dissolving each other at elevated temperatures. Of course, alloys of the aforementioned metals may be used by those skilled in the art.

Other metal pairs may alternatively be used to form an LCA wire to produce surprisingly high specific conductivity and impulse tolerance. Exemplary criteria to be used in selecting appropriate metal pairs include the following. The metal for the fusible core 104 should have a high specific conductivity, high specific heat, high heat of fusion, and, if permissible fusion is to be used in an application, the fusible core 104 should have a melting point below the appropriate maximum service temperature. The conductive wall 102 should be chosen from metals having high specific conductivity, high specific heat, and adequate structural strength at the operational temperature range of the wire 100. The fusible and wall metals are preferably immiscible at operating temperatures so that they do not dissolve each other, or else means must be provided to prevent them from dissolving each other, such as protective layers or body forces that maintain their separation.

Figure 2:
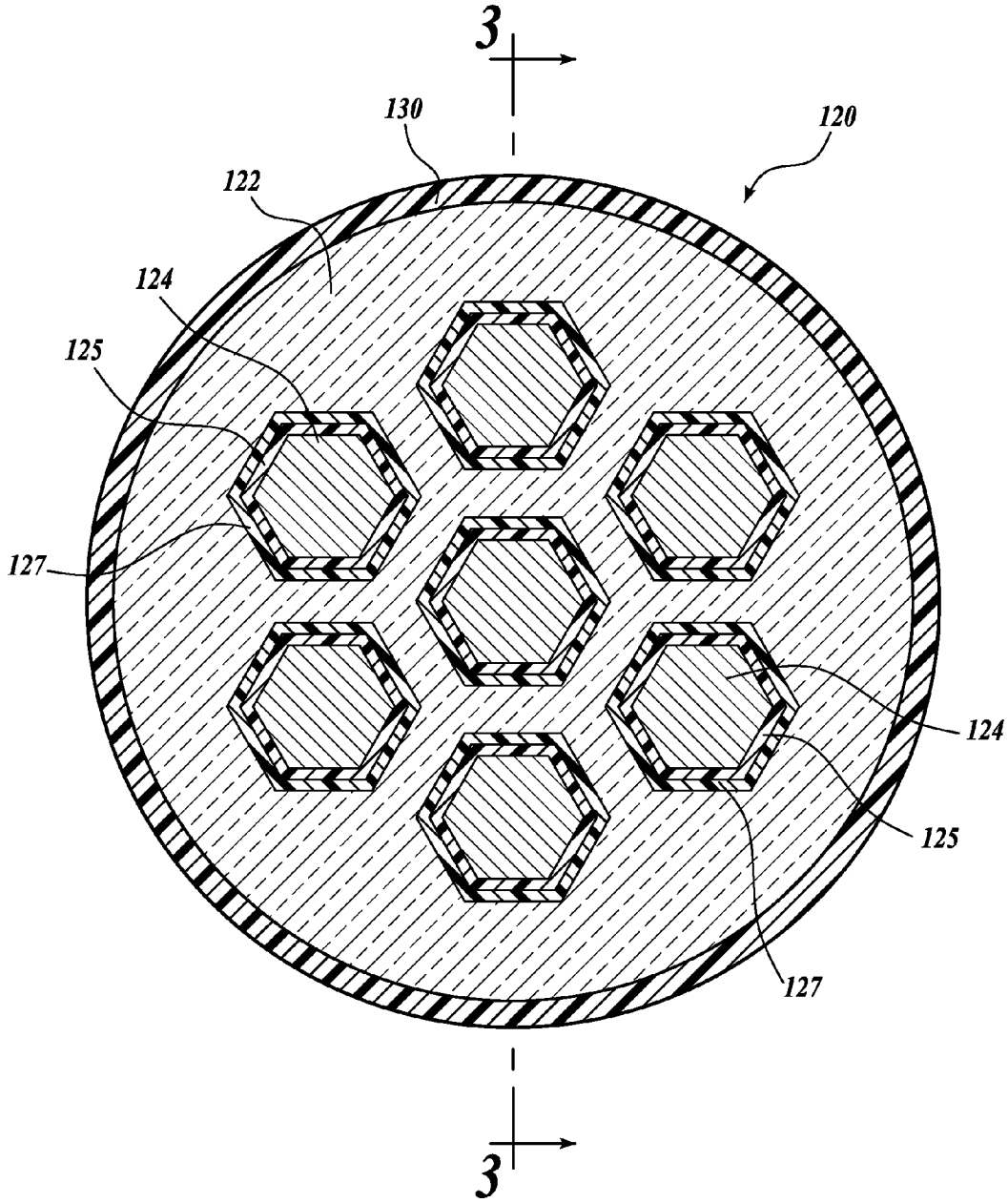
FIG. 2 is a transverse cross-sectional side view of a second embodiment of a wire in accordance with the present invention.

FIG. 2 shows a transverse cross-sectional view of an alternative embodiment of a wire 120 according to the present invention, wherein the core comprises a plurality of parallel elongate core elements 124 formed in a close-packed, thin-walled array, and disposed within a conductive wall 122. The core elements 124 may be formed of sodium, for example, and the wall 122 may be formed of aluminum. In this embodiment, an inner layer 125 of lithium and a protective layer of copper 127 separate the sodium core elements 124 from the aluminum wall 122. An aluminum oxide layer 130 insulates and protects the outer surface of the wall 122. Other barrier materials may also be suitable for particular applications and are contemplated for either of the intermediate layers 125 and 127, including for example molybdenum.

Figure 3:
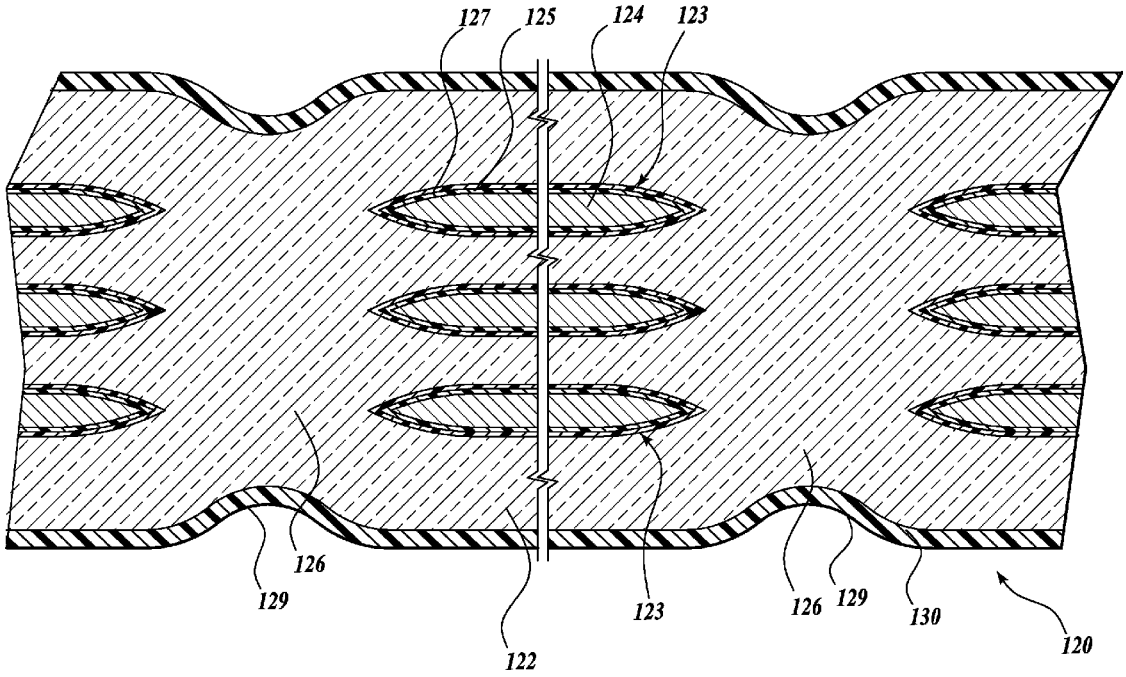
FIG. 3 is a longitudinal cross-sectional view of a short length of the wire shown in FIG. 2.

Refer now also to FIG. 3, which shows a longitudinal cross section of the wire 120. The wire 120 comprises an array of thin-walled cells 123 that are generally hexagonal in the current embodiment, and with intermittent transverse bulkheads 126 longitudinally separating the cells 123. The hexagonal cells 123 are arranged in a conventional round pattern as shown in FIG. 2, although other arrangements may be alternatively used, for example a more elliptical/rectangular pattern for greater heat rejection. In one embodiment, the wall 122 is about 1 to 100 microns thick, and the cells 123 are from about 10 to 3000 microns wide. The cells 123 are preferably sized such that capillary effects will not allow escape of molten sodium from a breached cell. It will be apparent to persons of skill in the art that the cells 123 may alternatively be shaped other than hexagonal.

A single microfluidic continuous casting ("MCC") process may be used to produce the wire 120. In particular, the wire 120 may be produced with a varying wall and cell size. In a continuous casting process the wall thickness and other dimensions may easily be continuously altered along the length of a single wire to meet the specific needs of the end user. For example, the cells may be widened in only those focal areas that require greater impulse tolerance, or the honeycomb walls may be focally thickened in only those areas where the wire will be exposed to increased mechanical stress concentrations (such as at connection terminals). The cell size can periodically be reduced to zero to form the regular transverse bulkheads 126 that separate linear cells 123 into hermetically sealed capsules.

One important consequence of the manufacture of wire 120 via the MCC processes is that cells obtain a capacity to retract core material if breached. In the MCC process disclosed in the provisional application, cells are encased at high temperature while in a molten state. During subsequently cooling to room temperature, a cell tends to shrink faster than the volume formed by the walls that encase it. For walls of sufficient thinness, however, atmospheric pressure forces the cell walls to bend so as to form a cell volume that conforms to the volume of enclosed metal. Said walls are stretched to yield stress at room temperature, and these thermally imposed internal stresses urge the wall to return to its unstressed state. Such a return to an unstressed state, however, is frustrated by a persistent atmospheric pressure differential across the wall. However, upon breach, air flow into the breach eliminates the pressure differential, and re-expansion is no longer frustrated. If the core enclosed in the cell is molten during breach, incoming air will push the molten metal into space created by the expansion of the cell. The volume of such retraction is limited by the size of the cell, which is usually proportional to the distance between bulkheads. In subsequently disclosed embodiments, however, it will be shown how unlimited retraction can be achieved, regardless of cell size.

Referring still to FIG. 3, the wire 120 may be formed with an indentation, waist or reduced thickness portion 129 at the location of the transverse bulkheads 126. The wire 120 is preferably cut and connected at said bulkhead 126. The waist portions 129 provides a visual and tactile indicator that makes it simple for the user to cut the wire 120 through the center of transverse bulkheads 126, for example when installing the wire 120. It is contemplated that the waist portions 129 may also be provided with a copper cladding that may be separately insulated (not shown) to improve and simplify making connections to the wire 120 at these locations.

In an alternative embodiment, the transverse bulkheads 126 may be omitted, for example to save weight and/or to simplify manufacturing the wire. If the transverse bulkheads 126 are omitted, lengths of wire may be terminated, for example, by electrical adapter plugs (not shown) having parallel refractory micro-needles that insert into the parallel sodium micro-channels of the wire, effectively sealing sodium from the environment while providing excellent electrical contact.

Pure (or nearly pure) sodium is generally preferred for the core elements 124 because of its superior density adjusted conductivity and very low cost. However, it is contemplated that other metals or alloys may be suitable for particular applications. For example, in some applications it may be desirably to use core elements 124 having a melting temperature that is different from the melting temperature of pure sodium. The melting point of the core elements 124 may be selectively adjusted at slightly increased electrical resistance and moderately increased economic cost by alloying certain materials with the sodium. For example, the melting point of the wire 120 can be lowered down to −12° C. by alloying the sodium with potassium. Alternatively, lithium may be alloyed with the sodium to increase the melting point. For unusual design temperatures, other materials may be better for the fusible filling and the structural honeycomb.

Lithium can be added simply by alloying it with the sodium. However, a sodium core element covered with a film of lithium has superior electro-thermodynamic performance than a homogenous sodium/lithium alloy made of the same amount of the two metals. This is because the less-conductive lithium, when alloyed with the more conductive sodium results in slightly decreased conductivity of the homogenous alloy compared to an equal amount of heterogeneous laminated sodium and lithium (e.g., LCA) that are electrically in parallel.

Insulative coatings or wall may be used to create a multi-conductor wire. The wall 122 may be omitted or replaced with a dissolvable material for applications where individual filaments of the wire are to be synergistically embedded into structural components of a device so as to provide superior structural support and a heat sink for the filaments.

In the present example, during an impulse of electricity, current flows through both the aluminum wall 122 and the sodium cells 123. Both sodium and aluminum have specific conductivity greater than copper; so little resistive heat is generated per unit mass. Under sufficiently high and persistent load, the sodium will melt and its conductivity will thereby decrease by about one-half. However, the aluminum wall 122 continues to be highly conductive at the melting point of sodium. In fact, heat transfer from the aluminum to the melting sodium will aid in keeping the aluminum cool and thus more highly conductive than if it were not thermally coupled with sodium.

Sodium expands with increasing temperature approximately four times as rapidly as the aluminum. In one embodiment at room temperature the thin-walled honeycomb cells 123 have a slightly squashed geometry with stressed walls that urge the cellular volume to expand, said expansion frustrated by atmospheric pressure. Therefore, as the wire 120 heats, the expansion of the soft but essentially incompressible sodium is accommodated by the cell walls 122 as they relax while assuming a rounder geometry. Upon breach, said wall stresses urge expansion of cell volume that retracts sodium.

The wire 120 rejects a small amount of heat during brief current impulses. However, most of the heat generated by a brief impulse is not transferred to the wire's environment until after the impulse is finished. Heat rejection is aided by the wire's relatively large surface area per unit mass, as well as the preferred means of fixation by thermally conductive adhesive. If the impulse is great enough to melt the sodium core elements 124, the wire 120 will remain approximately at the sodium melting temperature for a relatively long period of time as heat energy is dissipated. The wire 120 then rejects heat over a relatively large and constant temperature gradient. When the wire core 124 completely freezes, most of the stored heat from the previous maximal impulse has been rejected. The small remaining portion of stored heat is rejected as the wire's temperature decreases to room temperature.

In another embodiment the design of the wire's conductor and insulator are optimized for the safe and economical use of inexpensive commercial grade sodium. In addition, an inexpensive means for automatically mitigating risk of fire and the like in the event of an accident is disclosed. The mitigation is achieved by configuring the wire to automatically move sodium away from any break into unaffected cells while simultaneously shifting insulation toward the break.

Figure 4A:
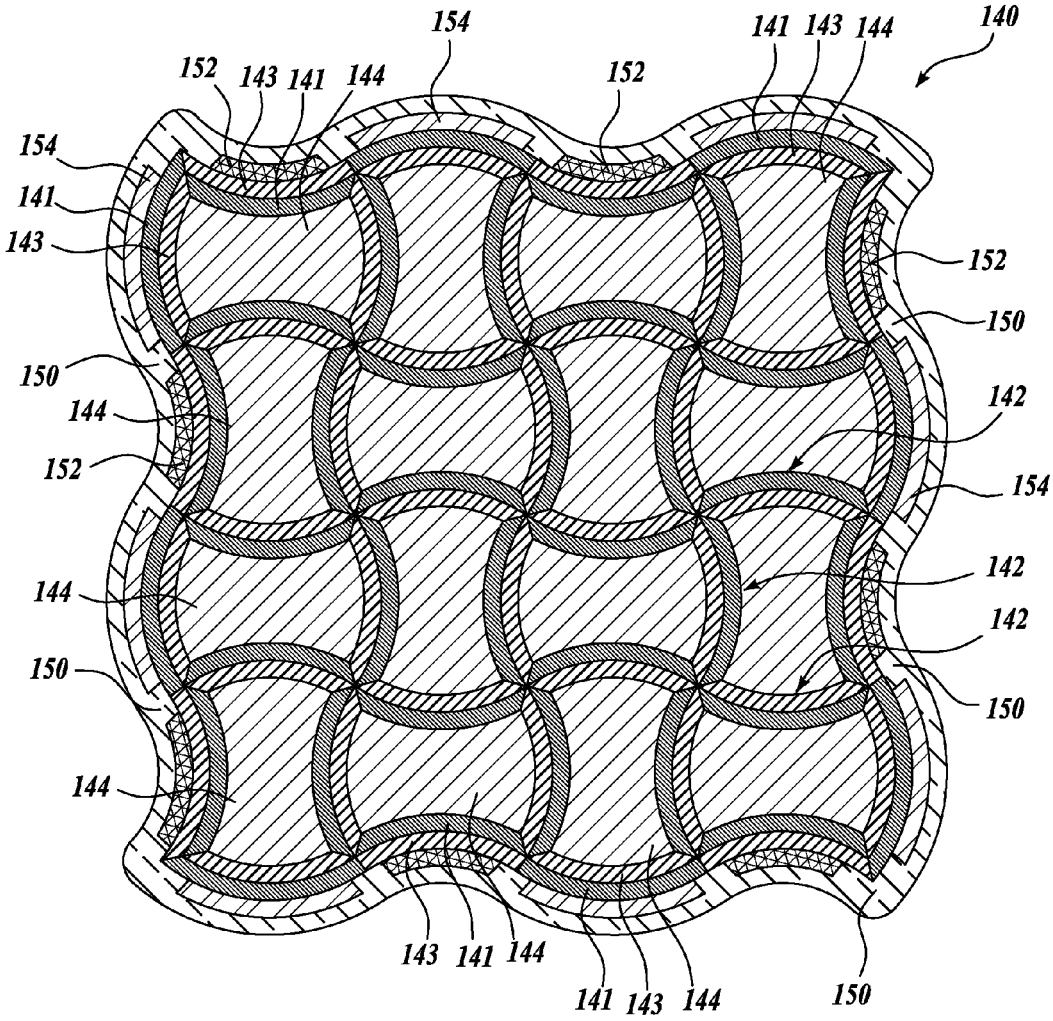
FIG. 4A is a transverse cross-sectional side view of a third embodiment of a wire in accordance with the present invention, wherein the wire includes a re-entrant wall structure.

FIG. 4A is a transverse cross-sectional diagram of a third embodiment of a wire 140 in accordance with the present invention, the cross section being taken at a location between bulkheads. The wire 140 is formed as a multi-channel microtubular LCA, with composite walls 142 formed of at least two different materials having differing coefficients of thermal expansion ("CTE"). For illustrative purposes, the wire 140 is shown as a four by four array of core elements 144 surrounded and separated by walls 142. The particular number and arrangement of core elements 144 is not critical to the invention, and it is contemplated that the wire 140 may be formed with a different number of core elements 144, and/or with core elements 144 arranged differently. The walls 142 are curved bimetallic walls having first wall components 141 formed of a relatively low CTE material on the convex side of each wall and second wall components 143 formed of a relatively high CTE material on the concave side of each wall. Under normal operating conditions, when the wire 140 is resistively heated above room temperature, the bimetallic effect will urge the walls 142 toward a flatter profile, thereby increasing the volume available for the sodium core elements 144 that are contained therein.

For example, if the wire 140 operates in a vacuum environment, small vacuum gaps develop between the sodium core elements 144 and the walls 142, reflecting the difference in volumetric thermal expansion between the greater expansion of a space contained by the walls and the lesser expansion of the sodium within. Of course, under normal operation, atmospheric pressure keeps the walls 142 in contact with the sodium core elements 144.

A calibrated mismatch in thermal volume expansion between the wall components 141, 143 and the enclosed sodium core elements 144 causes elastic stresses in the curved containment walls 142 as they are constrained by atmospheric pressure during heating. This stress urges the walls 142 toward a more flattened shape, thereby enlarging the cellular space that contains sodium. However, atmospheric pressure frustrates a cell's tendency to expand beyond the volume of its contained sodium.

When an exterior wall is punctured, the pressure differential across the wall suddenly decreases or is eliminated, and the sodium core 144 rapidly equilibrates with atmospheric pressure. The wall 142 flattens, increasing the defined volume as discussed above, aided by stresses induced by the wall elements 141, 143. Atmospheric pressure at the break pushes the sodium core 144 deeper into the wire 140 as the walls straighten to produce additional cellular space, thereby accommodating the inward flow of sodium.

Preferably, the channels defined by the walls 142 are narrow enough to form capillary tubes, and they prevent air from entering in the form of bubbles. Air can only enter by pushing the liquid sodium core 144 meniscus deeper into the wire 140.

In this embodiment, as the sodium core 144 surface moves away from the breach in the wall 142 it chemically depletes the oxygen in the air that enters the wire 140 as it forms a smothering sodium oxide crust. The residual trapped gas comprises primarily nitrogen, which is known to be unreactive with liquid sodium. It will also be appreciated that as the sodium core surface retracts, heat from oxidation is dissipated over a relatively large area of wall 142 along the way.

Liquid sodium is known to burn at just under its boiling point (883° C.). It is not coincidental that the burning temperature is so close to the boiling temperature. The heat of combustion of sodium far exceeds its heat of fusion. Burning liquid sodium cannot support any higher temperature than its boiling point because of course beyond this point the liquid ceases to be a liquid.

A true sodium fire (a runaway oxidative chain reaction) may be distinguished from mere transient sodium oxidation, wherein no significant amount of sodium vapor is released. In the case of rupture at ordinary atmospheric air temperature and oxygen concentration, sodium core 144 retraction, as discussed above, and insulation protrusion stops sodium oxidation before a true sodium fire can develop. However, in the event of rupture at supra-atmospheric oxygen concentration and/or temperatures approaching the boiling point of sodium, sodium vapor may be emitted from the retracted sodium meniscus and combust with the environment outside the wire. Heat from such burning vapor may then transfer back to the liquid sodium, causing more liquid to be transformed into vapor to continue the burning process.

However, the design of the wire 140 makes such a fire transient. To continue to create sodium vapor, heat from burning vapor just outside the break must travel a relatively long distance through products of combustion, nitrogen gas and/or sodium vapor in an open microchannel so as to reach remaining liquid sodium. Such intervening materials are very poor conductors of heat. The only significant means of heat transmission from burning vapor at a breach to the corresponding liquid sodium meniscus is via the thin metal containment walls.

A vaporizing sodium meniscus is rapidly cooled because the flow of heat out of the sodium meniscus into the remaining intact wire is much greater than the transfer of heat into the sodium meniscus from sodium vapor combusting outside the conductor. This is due to two reasons. Firstly, the thin metal sodium containment shell is very hot next to a fire just outside the break in the microtubing defined by the walls 142, and thus has relatively poor thermal conduction in this region. However, away from the fire, where the metal is cooler, the metal shell rather efficiently dissipates heat away from the liquid sodium core elements 144 into the cooler portions of the wire 140. Secondly, and more significantly, the intact wire 140 away from the fire still has cells 144 filled with thermally conductive sodium. It is estimated that almost 97% of the cross-sectional area of an optimal intact LCA wire 140 is sodium metal, the remainder the bimetallic containment wall 142. However, when the sodium is burned or retracted away, the only significant thermal conductor that remains is the containment wall 142, which occupies less than 4% of the cross-sectional area of the original wire 140.

If a segment of the wire 140 is breached while the core elements 144 are in the solid state, only the sodium in the breached segment is contaminated with oxygen. The rest of the wire remains sealed off from oxygen.

If a segment of the wire 140 is breached while the corresponding sodium core elements 144 are soft hot solid or liquid, the sodium retracts away from the breach toward the bulkheads of the breached segment.

Figure 5A:
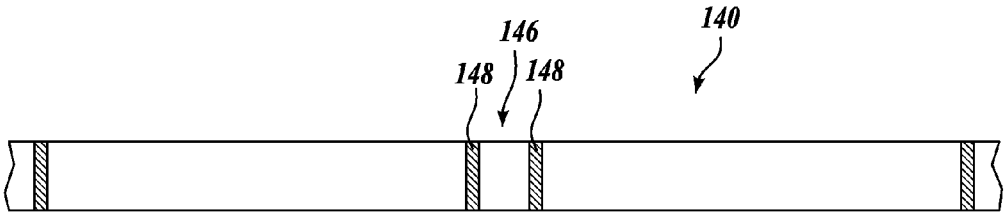
FIGS. 5A and 5B are a simplified side view diagram showing aspects of the bulkhead for the wire shown in FIG. 4A.
Figure 5B:
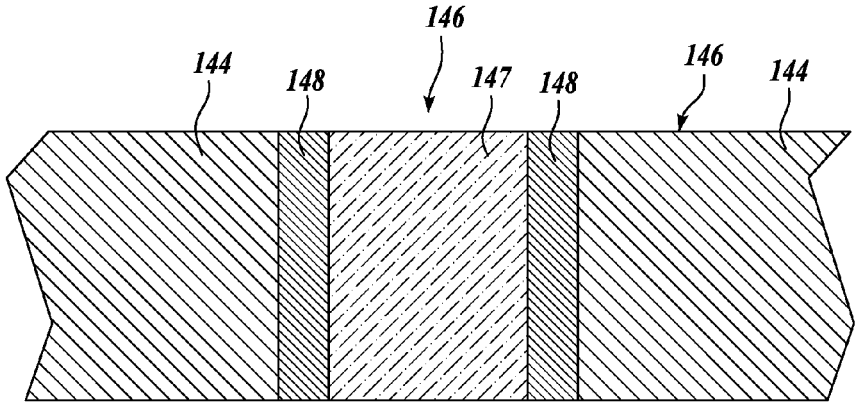

The wire 140 includes periodic or intermittent transverse bulkheads 146, similar to the transverse bulkheads 126 discussed above. A simplified sketch showing a cross-sectional side view of contents of a portion of a single conductor channel of the wire 140 is shown in FIG. 5A, and a close-up cross-section is shown in FIG. 5B at a single conductor bulkhead 146 inside a single conductor channel, to show aspects of the bulkhead 146. The bulkhead end portions 148 are preferably refractory to liquid sodium at normal operational temperatures, and has a melting point well above the normal operational temperature of the wire 140 but well below the temperature of burning sodium. The bulkhead main portion 147 is preferably a low-melting solder (preferably tin) impregnated with copper powder. End portions 148 are preferably a eutectic magnesium aluminum alloy (or a eutectic aluminum copper alloy for higher normal operational temperatures). A suitable eutectic magnesium aluminum alloy has approximately 34% by weight aluminum, the remainder magnesium, and a melting point of only 437° C. Both solid aluminum and solid magnesium are known to be resistant to corrosion by immobile liquid sodium at normal operational temperatures. Furthermore, at the elevated temperatures of a sodium fire, both liquid aluminum and liquid magnesium do not significantly mix with liquid sodium.

In a particular embodiment, the bulkhead solder/copper mixture comprises solid copper distributed in an alloy of tin that contains a small (~<1%) amount of dissolved copper as a consequence of the preferred MCC process of manufacture of said mixture. The copper is preferably filamentous, with the filaments generally aligned with the longitudinal axis of the wire 140, except beneath the indented region of the bulkhead 146, where the copper filaments are preferably interrupted with nonfilamentous copper powder. The bulkhead main portion 147 may, for example, be 29% by weight copper at the filamentous portion so as to achieve overall conductivity equal to the adjacent sodium element 144 portions. The portion of the bulkhead 146 that underlies the indented portion of the wire preferably has a higher proportion of copper to help compensate for the lower cross-sectional area, thereby avoiding the creation of a hot spot.

The filamentous structure increases conductivity and tensile strength except underneath the indentation, where the decreased tensile strength of copper powder aids preferential breakage down the middle of a bulkhead when the wire is intentionally cut or accidentally torn.

Such micro-architecture of the bulkhead main portion 147 is achievable, for example, using microfluidic continuous casting technique. For the filamentous portion of the main portion 147, pure liquid copper may be injected into co-flowing pure relatively cool molten tin, both metals surrounded by a co-flowing coolant, with magnetic compensation to counteract the difference in mass density between the co-flowing materials.

The copper jets preferably flow at the same rate as the coflowing tin. When the indented portion of the wire is formed, however, the magnetic field motion is preferably reversed and the velocity of the copper jet is increased well above the tin velocity so as to intentionally create velocity and density mismatch that, in conjunction with the magnetic field motion direction reversal, results in the formation of tiny copper droplets instead of smooth copper filaments. As a result of the increase in relative copper velocity at the indented portion of the wire, there is a concomitant increase in the proportion of copper underlying an indentation.

An inconsequential amount of copper will dissolve from the filaments into the tin during the continuous casting process. The final bulkhead fluidizing component will therefore be an alloy of tin with a small amount of dissolved copper.

The magnesium aluminum alloy functions as a refractory solid bulkhead during a breach at normal temperature. However, if extreme environmental conditions cause unusually high temperatures to develop at a given segment despite the retraction of sodium and protrusion of insulation within that segment, then the temperature of that segment may become high enough to dissolve, weaken, melt or breach bulkheads between the affected segment and an adjacent cooler segment. The breach of a conductor bulkhead in this situation is desirable, leading to further retraction of sodium from the affected segment into adjacent cooler segments.

Since magnesium aluminum alloy is flammable, it is only used as a thin layer to separate the sodium core elements 144 from the non-burning but sodium soluble solder in the bulkhead main portion 147. Copper powder impregnated solder forms the bulk of the meltable bulkhead 146, not the magnesium aluminum alloy. Copper powder is not only highly electrically conductive, it is also known as an excellent fire extinguishing material for metal fires.

Of all the alloys sufficiently refractory to corrosion by 98° C. sodium, eutectic aluminum magnesium alloy apparently is the one with the lowest melting point (437° C.). This low melting temperature, well below the boiling point of sodium, facilitates the early recruitment of adjacent segments for the purpose of sodium retraction. The use of a eutectic aluminum copper alloy for bulkhead end portions 148 on the other hand would delay recruitment of retraction from adjacent segments, as this alloy melts at 548° C. However, the use of eutectic aluminum copper for end portions 148 would permit higher normal operating temperatures that would dissolve a eutectic magnesium aluminum alloy.

The low melting point of eutectic magnesium aluminum alloy facilitates manufacture of the wire 140 using a microfluidic continuous casting method of manufacture such as that disclosed in the incorporated provisional patent application. Sodium-refractory bulkhead metals of higher melting point could be used, but the added requirement to insulate liquid higher-temperature refractory bulkhead material from the preferably lower-temperature liquid sodium consumes space in the microfluidic continuous casting apparatus that could otherwise be used for wider liquid metal conduits that allow faster extrusion of wire. (The injection of lower-temperature liquid sodium is preferred to limit transient corrosion of containment walls by hot sodium). Thus the end result of a higher-melting bulkhead is a slower rate of conductor synthesis. The use of slurries can partially overcome the necessity of hotter working temperature, but the additional viscosity of slurry over a pure liquid again decreases overall throughput. This is why a eutectic magnesium aluminum alloy is preferred.

The bulkheads 146 serve additional functions unrelated to fire suppression. For example, during installation, the wire is preferably cut through a bulkhead 146 such that one half of the bulkhead 146 seals one of the cut ends of the wire 140 and the other half of the bulkhead 146 seals the other cut end of the wire 140. Thus there is no need for any special procedure to cut the wire 140 without exposing the sodium to air; one may simply cut the wire 140 at marked linear transverse indentations similar to the indentations 129 discussed above, placed in the middle of the bulkheads 146.

The indentations preferably have the precise depth sized such that the tensile strength of the wire 140 at the indentation to slightly less than the tensile strength away from the indentations. Therefore, if the wire 140 is stretched too much, it will tend to break through the middle of a bulkhead 146 rather than through a sodium core element 144. Also, for thinner gauges of the wire, the wire can be neatly bent a few times then snapped apart at an indention with bare hands.

For a wire such as wire 140 with an essentially square cross section, the orientations of every indentation is preferably orthogonal to both the longitudinal axis of the wire and the neighboring indentations, e.g., indentations alternately vertical and horizontal. Alternately orthogonal indentations serve as hinges that relieve some of the stress that occurs from bending the wire 140 in any direction. Similarly, for wire with a hexagonal cross section, indentations may be oriented on opposite faces of the six-faced wire, each indentation rotated 60 degrees from the preceding indentation.

For a substantially flat wire (e.g., a wire having a first transverse dimension much greater than a second transverse dimension), the linear indentations (and underlying bulkheads) may be oriented alternatively 45 and 135 degrees with respect to the longitudinal axis of the wire, always in the plane of the wire. Such hinges are still oriented orthogonal to each other. But, in contrast to the square wire 140, the hinge axes are both perpendicular to a transverse axis rather than the longitudinal axis.

The bulkhead 146, when cleaved in two, provides a sturdy, chemically stable, electrically conductive "pretinned" wire termination suitable for attachment to an ordinary electrical terminal post or circuit board contact. In many cases, the LCA wire 140 is easier to connect than conventional copper wire. For connection to a small metallic contact pad on a circuit board for example, the flat cut surface of the wire 140 may be placed against a contact pad, and an electrical impulse run therethrough to neatly weld or solder them together.

Figure 4B:
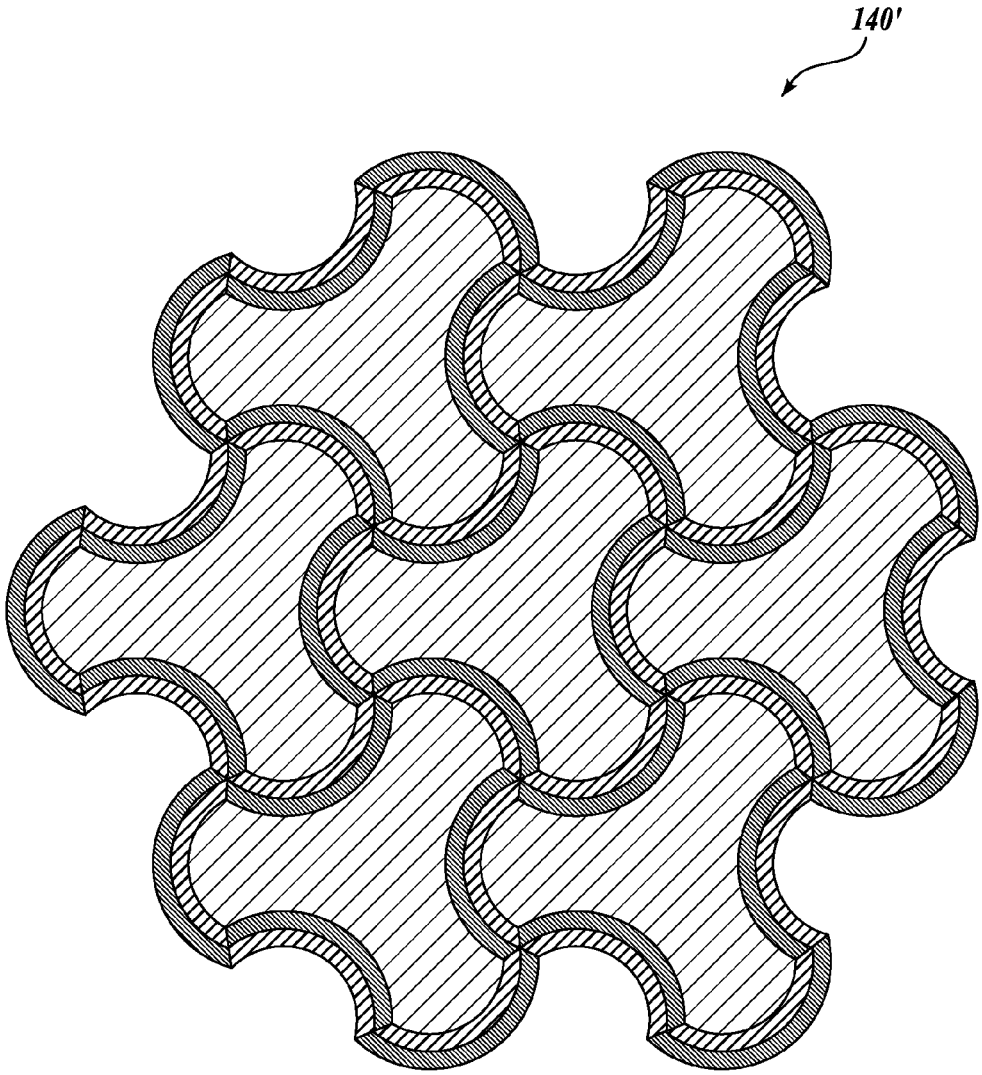
FIG. 4B is a transverse cross-sectional side view of a fourth embodiment of a wire according to the present invention, showing another exemplary re-entrant wall structure.

In the wire 140 thermal bimetallic effects are used to change the containment volume not by uniformly shrinking and expanding the shell but rather by elastically bending the shell in response to temperature so as to create cross-sectional shapes that have almost constant perimeters but significantly decreasing or increasing area. Similar volume change utilizing the bimetallic effect may be similarly accomplished, for example, in an LCA formed as an array of hexagonal elements 140', as shown in FIG. 4B. Other tessellations of cross-sectional area are certainly possible wherein cells of the array shrink by a bimetallic effect to fill a decreasing cross-sectional area. The novelty lies not in the choice of square, hexagonal, or any other shape of cell arranged in an array per se, but rather in using the bimetallic effect to (1) repeatedly shrink and expand the volume of the container to almost follow the sodium so as to prevent plastic deformation, but (2) intentionally causing the relaxed heated container volume to be slightly more than the sodium volume so as to create elastic stresses in the wall at higher temperatures that cause sodium to retract in the event of a breach.

The basic structure of the wire 140 may be classified as a "re-entrant" structure, meaning parts of the structure collapse into the structure so as to cause overall shrinkage. Some re-entrant materials exhibit a negative Poisson's ratio, defined as the ratio of imposed elongation to shrinkage in the transverse direction. As is well known to those skilled in the art, in a material with a negative Poisson ratio, stretching the material causes unusual expansion of the material in the transverse direction (instead of the usual shrinkage in the transverse direction).

Re-entrant materials with negative Poisson ratios are not new. However, re-entrant microstructures typically require tremendously uneven bending of the walls which would cause stress concentrations exceeding the elastic limits of any metal refractory to sodium. In the wire 140, however, stress is evenly distributed throughout the wall segments, which are all bent in identical gentle circular arcs. The present re-entrant structure evenly distributes the stress of bending to all components, resulting in an elastic material that can be cycled repeatedly through a large volume difference, always staying well within the elastic range without degradation from plastic deformation.

The maximum change in cross-sectional area that the square cell embodiment geometry allows is about 41% of the fully expanded area. At 41% shrinkage, opposing walls are semicircular arcs that touch each other. Actually, the cells could shrink even more, but the walls would become noncircular, and stress in the wall would become uneven.

The maximum possible change in the cross-sectional area of the bimetallic hexagonal re-entrant LCA shown in FIG. 4B is even more than that of the square LCA shown in FIG. 4A. However, for currently contemplated applications only about half of the potential change in cross-sectional area of the square LCA is required.

A bimetallic strip, such as the type used in thermostats, usually curves around an axis that is perpendicular to the longitudinal axis of the strip. However, in the wire 140 the metal strips or wall components 141, 143 curve around an axis that is parallel with the longitudinal axis of the strip 141, 143. Such curvature around the longitudinal axis of the metallic strip does occur in a typical bimetallic thermostat, because the bimetallic effect is planar, not linear. However, in a thermostat such transverse curvature is insignificant and irrelevant to the design and is usually not considered. The use of transverse bimetallic curvature is believed to be another unique aspect of the wire disclosed herein.

In a particular example of the wire 140, the high CTE material is a beryllium copper alloy and the low-CTE material is an alloy of iron and nickel. Specifically the C 17200 alloy of beryllium copper and the Invar® 36 alloy of Invar, are currently preferred.

Both Invar 36 and C 17200 beryllium copper are commercially available, strong and highly resistant to stationary molten sodium near its melting point. The preferred alloys also have nearly the same mass density at the melting point of Invar, which is important for the preferred MCC method of manufacture (discussed below).

Invar is well known as having a surprisingly small coefficient of thermal expansion. This is believed to be due to magnetorestrictive effects that operate below the alloy's Curie temperature of 230° C. If Invar is heated to near its Curie temperature, these magnetic effects gradually go away and the CTE of Invar increases (although it remains less than beryllium copper).

It is the difference in CTE that drives the bimetallic effect. When initially heated from room temperature, it is desirable to rapidly establish a large amount of stress in the bimetallic wall, before the sodium melts. Fortuitously, the CTE of Invar is very low in the temperature range just above room temperature.

When the wire 140 is heated from room temperature by electrical current, wall stress increases rapidly with increasing temperature because of the large CTE difference between Invar and beryllium copper in this temperature range. A frustrated volumetric mismatch rapidly develops between the incompressible sodium and the shell around it. In most applications, the wire 140 would be sized so as to not be heated beyond 98° C. during normal operation. The stress in the wall 142 would remain in the elastic range during such normal operation, with the elastic limit of the wall surface preferably occurring just as the sodium melts. It is desirable to have such peak stress at this temperature, because the wall's spring force is most needed around this temperature. By staying in the elastic range, the wire's wall 142 can be repeatedly stretched and compressed as the sodium is repeatedly melted and frozen during normal operation, without degradation of the containment shell. The wire 140 has precise dimensions that cause an elastic-plastic transition to occur as the wire is heated past its maximum operational temperature.

In the event of overcurrent or fire, the temperature of the wire 140 could significantly exceed the elastic range of operation. As temperature rises above the maximum normal operating temperature, the deformation at various layers of the walls becomes increasingly plastic rather than elastic. Wall stress, however, continues to urge the cell volume to expand and the cell volume will still expand in the event of a breach. In fact, a fully plastically stressed wall produces a wall bending moment approximately 50% greater than the moment created by a wall that is fully elastically stressed. The wall continues to have such stress all the way up to the boiling point of sodium, at which point the wall becomes completely flat and a small amount of vapor is contained by stretching of the wall. Eventually, excessive heating will cause vapor pressure high enough to breach a wall.

As previously mentioned, the wire is not optimized for frequent plastic deformation because this would result in metal fatigue and failure. However, the wire may be stretched and compressed through the plastic range a limited number of times without breaking.

It will be apparent to persons of skill in the art that similar wire with different metals could be designed for normal operation at extreme temperatures using the principles taught herein. However, it is believed that applications for such a wire would be unusual.

Design of the Insulator:

Refer again to FIG. 4A, showing a cross section of the wire 140 through sodium core elements 144. An insulative comparatively refractory material forms an outer layer 149 with longitudinally directed septa 150 that project inwardly. The size of said longitudinal septa 150 are greatly exaggerated in FIG. 4A, for clarity. Preferably, the septa 150 would only project on the order of 20 microns. The longitudinally extending septa 150 connect with outer walls 142 of the conductive wire 140 generally at locations where the walls intersect. The connection may be formed, for example, during a microfluidic continuous casting process by casting small sliding dovetail joints that provide an interference fit with the refractory insulator layer 149. Other means for fixation capable of withstanding temperatures up to the melting point of the refractory insulator are possible.

The insulative septa 150 define channels between the outer walls 142 and the outer layer 149, each of which contains either a first fusible material 152 or a second fusible material 154. In the preferred embodiment, the first fusible material 152 has a melting point slightly above the maximum normal operating temperature of the wire 140, the second fusible material 154 has a melting point below that of the maximum normal operating temperature of the wire 140, and the CTE's of both fusible materials 152, 154 are greater than the CTE of the outer layer 149.

Because the fusible materials 152, 154 have CTE's greater than the outer layer 149, the outer layer 149 will be stretched when the wire 140 is heated, producing a compressive force on the fusible materials 152, 154. Furthermore, as previously described, the conductor portion of the wire 140 also expands when heated, and greatly expands when breached. Thus, the fusible materials 152, 154 are squeezed between the outer layer 149 and conductor outer walls 142, especially in the event of a breach of the wire 140.

If the wire 140 is breached when heated close to the maximum normal operating temperature of the wire 140, the second fusible material 152 is extruded into the breach. Should the wire 140 be breached when heated sufficiently beyond the maximum normal operating temperature of the wire 140, then both fusible materials 152, 154 are melted and extruded into the breach. At such elevated temperature, when more fire extinguishing material is required, more material is automatically provided. The viscosity of both fusible materials 152, 154 decreases with temperature. Therefore, again, the volumetric rate of flow rises in proportion to need.

Although fusible insulation materials 152 and 154 preferably have high and similar dielectric constants, competing considerations such as melting point, flow rate and cost may lead to selection of materials 152 and 154 with different dielectric constants. To assure no portion of the insulator has significantly less electrical resistance than another, the first fusible material 152 with higher dielectric strength, for example, is placed over the outwardly convex surfaces of the conductor, the second fusible material 154 overlies the outwardly concave surfaces, and the layer of dielectrically weaker fusible insulation 154 is made sufficiently thicker.

Material for the outer layer 149 may be chosen from the many formulations of high melting point, flexible, electrically insulative, fire resistant material. Polyetheretherketones ("PEEK"), polyimide, and polytetrafluoroethylene ("PTFE") are examples of such material. PTFE is currently preferred because of its known resistance to molten sodium, low chemical reactivity and low coefficient of friction. Additionally, PTFE has a very high service temperature in air of 260° C., and does not melt until about 330° C.

Fusible materials 152, 154 are chosen from the many formulations of low melting, flexible, electrically insulative and fire resistant materials. For the preferred maximum normal operating temperature at the melting point of sodium, a wire/cable grade low density polyethylene ("LDPE") is preferred for the first fusible material 152, as such formulations are inexpensive, form a sodium fire smothering crust as taught in U.S. Pat. No. 3,333,049 and also generally melt around 108° C., only slightly above the preferred maximum normal operating temperature. A wire/cable grade ethylene vinyl acetate ("EVA") formulation with at least 12% vinyl acetate is preferred for the second fusible material 154 because said formulations melt below the melting point of sodium. Both LDPE and EVA formulations preferably contain known fire-extinguishing and viscosity-reducing additives.

Figure 6:
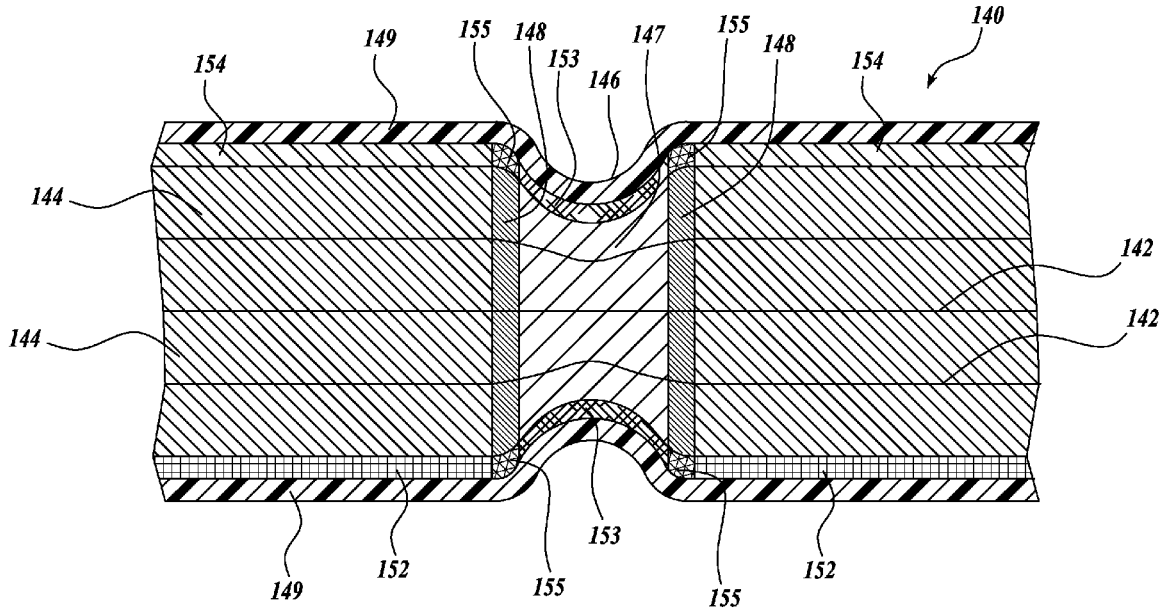
FIG. 6 is a cross-sectional side view diagram showing aspects of the wire shown in FIG. 4A.

A schematic side view of an embodiment of the wire 140 showing the insulator and conductor at a bulkhead 146 is shown in FIG. 6. In this embodiment, the insulation in the region of the bulkhead 146 includes portions of the fusible materials 152 and 154 separated longitudinally by a bulkhead comprised of material 153 sandwiched longitudinally between two layers of a semirefractory material 155. The preferred semirefractory material 155 melts when the temperature gets sufficiently high that it is desirable to recruit fusible material 152 and 154 from adjacent segments, for example to extinguish a possible fire. Fusible material 153 melts at a temperature between the melting point of semirefractory material 155 and the maximum normal operating temperature of the wire. The separate channels of fusible materials 152 154 are shown in FIG. 4A. The longitudinal septa 150 of refractory insulation run through the insulator portions 155 and 153 of the bulkhead 146, uninterrupted from the adjacent insulation segments.

As previously stated, the refractory outer layer 149 with longitudinally oriented septa 150 attach to the outer conductor wall 142, preferably at the point of intersection of walls 142. As shown in FIG. 6, the semi-refractory material 155, oriented transversely, is located at each bulkhead 146. The transverse semi-refractory members 155 have a melting point between that of the refractory insulator 149 and fusible material 152 (or 154). The refractory outer layer 149, refractory longitudinal septa 150, transverse semi-refractory members 155 and the conductor outer walls 142 form cells that preferably contain either fusible material 152 or fusible material 154.

For the preferred maximum normal operating temperature near the melting point of sodium, semirefractory member 155 is preferably chosen from the many flame retardant wire/cable grade formulations of nylon, and the fusible materials 153 is preferably a wire/cable formulation of LDPE with a colorant additive. The colorant additive provides color that shows through the thin preferably PTFE outer coating, aiding identification of the location of the bulkhead for purposes of cutting the wire.

Bulkhead insulation may be cut at a transverse bulkhead indentation or waist, through underlying relatively soft fusible insulation 153, between layers of relatively strong material 155. Each resulting cut end then has a seal comprising a semirefractory material 155, which prevents leakage of the fusible materials 152 and 154. Said seal is coated with a small amount of remaining material 153, which may optionally contain adhesive components that facilitate the connection of the cut end of wire 140.

Should an insulation segment be breached at a temperature less than the melting point of semi-refractor member 155, an intact insulation bulkhead prevents depletion of insulation in intact adjacent segments. However, should a breach occur at a temperature above the melting point of semirefractory member 155, the insulation bulkhead is breached, allowing recruitment of fire extinguishing insulation from adjacent segment(s).

Known refractory sodium fire extinguishing materials that are not significantly electrically conductive (for example sodium chloride and attapulgite clay) may be added to the insulation so as to form a composition that, in the event of overheating, melts into a slurry with sodium fire extinguishing capability superior to the fusible insulation alone.

The composite insulation preferably has the same thickness at the bulkheads as it does at the segments between bulkheads. Such uniformity may be achieved by known means, for example by indenting the wire after a uniform layer of composite insulation has already been applied to the unindented nascent conductor.

Of course the composition of the insulation may be modified by other known means to decrease its flammability, increase its strength, adjust its service temperature, adjust its melting temperature, decrease its cost, increase its flexibility, improve its durability and so on. With regard to the insulation, the invention lies not in any specific choice of insulation formulation per se but rather in the design of a multifunctional composite plastic insulative sheath that, in the event of breach during high temperature, functions as described above to transport plastic as needed from the wire's insulator to plug said breach and prevent fire.

To demonstrate the principles of practicing the wire simple examples of embodiment are disclosed. Of course, for particular applications, methods known to those skilled in the art may be employed as required to adapt the present invention. For example, abrasion resistant sheaths, reinforcing structural wires or chemical coatings may be added. A plurality of wires may be combined into a cable for increased flexibility per conductivity. Most importantly, the design principles disclosed may be used to choose materials suitable for operation at a great variety of normal operating temperature ranges.

A method for manufacturing the disclosed lightweight wires is discussed in the previously incorporated U.S. Provisional Patent Application No. 60/840,173. Additional disclosure of methods for manufacturing the wires will now be discussed.

The preferred embodiment of the microfluidic continuous casting ("MCC") method of manufacture, optimized for the purpose of manufacturing the preferred embodiments of LCA illustrated in FIGS. 4, 5 and 6, is as follows. To allow the use of gravity to aid return of coolant, the wire is preferably cast in an upward direction. Parallel streaming, upwardly-directed sheets of molten metal (e.g., Invar 36 and C 17200) freeze together, cool, and thermally shrink at different rates so as to produce the LCA shell of FIG. 4A, with curving walls that result in a shrinking cellular cross-sectional area. Said streaming freezing molten metals are surrounded by co-flowing bismuth lithium alloy coolant.

During the solid wall formation portion of the MCC process, the coflowing freezing wall metals never touch a solid. All three liquids (coolant and two wall metals) have virtually the same mass density at the relevant temperature, and they all flow at essentially the same velocity. Similar velocity and density prevent distortion as the wall metals freeze into a smooth wall.

One significant improvement of the present preferred embodiment over the embodiment described in the provisional patent is the use of a suitable metal alloy as coolant instead of xenon or radon. This is technically much easier to handle than highly compressed material. It also provides faster freezing. The preferred coolant for the preferred embodiment is an alloy consisting almost entirely of bismuth. Bismuth has a melting point of only 271° C., more than adequate insolubility to beryllium copper and Invar, and density only slightly more than Invar and Beryllium copper at the 1427° C. melting point of Invar. About ½% by weight lithium is preferentially added to the bismuth to decrease the coolant's melting point and make its density match the other preferred liquid metals.

When multiple materials of differing initial temperatures and differing melting points are cocast in the MCC process, the temperature of the interface(s) rapidly equilibrate and decline until the highest-melting material starts to undergo freezing. At this point the heat of fusion buffers the change in temperature. For this reason, the temperature at the interface remains at the melting point of the highest-melting material during most of the most critical part of the MCC process.

When the highest melting point material freezes, the solid film on said material contributes greatly to the stability of the interface. But until then, the liquid interface is potentially very unstable if density and velocity are not tightly controlled. Thus, it is desirable to choose materials that have equal density at the melting point of the highest melting material (as opposed to equal density at another temperature). In the specific example of cocast Invar and C 17200 alloy, the highest melting material is Invar, with a melting point of 1427° C. The densities of Invar 36, C 17200 and $Bi_{99.5}Li_{0.5}$ are all very close to each other at 1427° C.

A moving magnetic field can optionally be used to largely compensate for the increasing difference in mass density that occurs as the three metals cool from 1427° C. Due to varying electrical conductivity of the fluids, a single uniform moving magnetic field produces different amounts of force on adjacent fluids in accordance with Lenz' law, although the direction of force is always parallel to the path of the magnetic field. Differences between the fluids of gravitational body forces can thus be largely counterbalanced by differential magnetic forces on the fluids, the result being more equal uniform net force fields on all coflowing liquid materials throughout the freezing process. The strength and/or velocity of the moving magnetic field can be made to be different at each stage of cooling, such that at each stage the magnetic density compensation is optimal.

In general, electrostatic force may be used to maintain the separation of solid nascent conductor flowing close to solid components of the MCC apparatus. In particular, electrostatic force may optionally be used to aid separation of a sodium funnel (described below) from the nascent refractory wall of the wire.

The present preferred embodiment of the MCC process involves the walls of the wire being synthesized first into an LCA with empty cells, then a core being synthesized inside the cells of the LCA. This is in contrast to the alternative method described in the provisional patent which described synthesis first of an inner sodium core, and then a shell around the core. Either an "inside-out" or an "outside-in" method may be used, but the outside-in method is somewhat better, primarily because there is less high temperature contact between molten sodium and the nascent containment wall.

After freezing and cooling of the cell walls, the newly created empty LCA channels are injected alternatively with liquid sodium, liquid eutectic magnesium aluminum alloy, and copper/solder slurry so as to form the longitudinal structure of the cores, comprising sodium segments and interposed conductor bulkheads. The injection may be achieved using a thin refractory microneedle (preferably tungsten) along a path aligned with the axis of the middle of the microchannel. The microneedle never touches the nascent solid wall.

The microneedle tip is trumpet- or funnel-shaped, such that the edges of the tip of the microneedle are very close to the nascent solid containment walls, but the shaft of the microneedle is sufficiently narrow to provide sufficient space for egress of adjacent bismuth coolant from the MCC apparatus. Said bismuth coolant co-flows upward with the adjacent nascent wall, until, at a point after the wall has frozen, under the effects of gravity (and optional lithium pressure, discussed below), the bismuth reverses direction to flow downward adjacent to the sodium microneedle. The upward and downward streams of bismuth may optionally be separated by a thin baffle.

Heat from the cooling walls moves substantially transverse to the upward direction of wire formation. During the freezing of the walls, much of the heat from the walls eventually ends up at the center of the microchannel in the incoming sodium stream. Heat from the nascent cooling walls flows into co-flowing upwardly directed bismuth coolant, then to downwardly directed returning bismuth coolant, and then finally into upwardly moving sodium inside the microneedle.

Although much of the heat from the molten walls is absorbed by the sodium, the temperature of the sodium raises little. This is because more than 96% of the cross sectional area of a segment of the conductor is sodium.

There is preferably a gap between the funnel tip of the microneedle and the upper surface of the bismuth coolant (where the bismuth reverses direction). Bismuth is a poor electrical conductor, and contamination of sodium with bismuth is to be avoided. Said bismuth-sodium gap may be evacuated or filled with pressurized molten lithium via a thin microtube adjacent to the sodium microneedle. Without pressurized lithium, the return of bismuth is driven only by gravity, which limits the rate of synthesis of conductor. In this embodiment, the surface tension of molten sodium and entrainment of sodium on the rising conductor wall assures that sodium does not migrate downward through the small clearance between the sodium funnel and the nascent wall.

If, however, pressurized lithium is used, said pressurized layer of lithium serves to drive the returning bismuth downward, ultimately increasing the rate of wire synthesis. Depending on the relative pressures and flow rates of sodium, lithium and bismuth alloy, pressurized lithium may slowly leak upward into the small clearance between the sodium funnel and the nascent walls, providing a layer of lithium at the periphery of a cell, which has benefits described in the provisional patent application. A small amount of pressurized lithium also dissolves downward into the adjacent bismuth coolant. As previously explained, a low concentration of lithium in the bismuth coolant is preferred. The amount of lithium in the returning coolant may be regulated outside the MCC apparatus by known means before the coolant is reused.

The inter-diffusion between the lithium and bismuth layers is preferably reduced by providing a horizontal baffle that separates the lithium from the bismuth except at a small clearance between said baffle and the nascent conductor wall. Said baffle limits contamination of lithium with bismuth, which prevents contamination of sodium with bismuth-containing lithium. In the preferred embodiment, lithium pressure slightly exceeds bismuth and sodium pressure, such that lithium slowly flows up into sodium and down into bismuth via the clearances at the periphery of the funnel and horizontal baffle respectively. Retrograde diffusion of either sodium or bismuth into lithium is thereby avoided. This prevents contamination of sodium with bismuth.

Fluid or vacuum separates the microneedle and the freezing walls at all points of the MCC process. The inside cavities of the nascent wire are never exposed to atmospheric pressure, and the outside of the nascent wire is not exposed to atmospheric pressure until after the walls are solid. Sodium is not injected until the walls are cool enough for sodium corrosion of said walls to be insignificant.

After injection of the core elements, the filled conductor continues to be rapidly cooled from the outside using conventional means. When the eutectic magnesium aluminum alloy bulkheads freeze, the nature of the stresses and strains on the cell's wall changes. Before the bulkheads freeze, the curvature of the wall is only affected by thermal stresses which occur deep in the wall near the neutral axis.

However, once the bulkheads freeze, the wire further cools, and external atmospheric pressure is introduced, a frustrated volumetric mismatch begins to occur between the hermetic cellular container and the sodium within. The frustrated volumetric mismatch during cooling near the freezing point of the eutectic magnesium aluminum bulkhead behaves differently than the frustrated volumetric mismatch that occurs during heating of an LCA conductor from room temperature. First of all, the magnetorestrictive effects that cause Invar to have an extremely low CTE around room temperature do not operate at 427 C. Thus, the difference in CTE between Invar and C 17200 alloy is lower than it is at room temperature. Hence, at such elevated temperatures, the cell volume tends to change less with temperature than the sodium. This is the opposite of the situation near room temperature, where the cell volume tends to change more than the enclosed sodium with changes in temperature. Secondly, instead of differential expansion due to temperature increase, there is differential shrinkage due to temperature decrease.

At elevated temperature under vacuum, cooling causes the sodium to shrink faster than the cell that contains it. However, with subsequent introduction of external atmospheric pressure, the cell volume is forced to conform to the enclosed sodium. Curvature of a wall is forced to increase. Said bending of the walls creates tension at the low-CTE convex wall surface and compression at the high-CTE concave wall surface. Tension and compression builds until the wall starts plastically deforming.

During said plastic deformation the wall is cold-worked, which increases its yield stress, thereby increasing the force and rate of initial retraction during breach. Fortunately, the timing of temperature and plastic deformation commonly used to strengthen beryllium copper is similar to the timing of temperature and plastic deformation used to strengthen Invar. Such known temperature and cold working treatments used in non-microfluidic casting of these metals may optionally be largely reproduced in the MCC process by simultaneously treating the two connected metals so as to produce the strongest walls possible.

As Invar is cooled, the CTE of Invar increases, and thus the CTE difference between Invar and C 17200 increases. Via careful calibration of wall dimensions, the conductor can be made such that at around 98° C., the difference in CTE between Invar 36 and C 17200 alloy becomes sufficient for the wall to bend enough for the cell volume contraction to match the thermal contraction of sodium by thermal effects on the wall alone. This stops the plastic deformation and, as the temperature further decreases, increasingly relaxes the elastic tension in the wall, until the wall is essentially relaxed at room temperature.

Once the conductor portion of the wire is formed, it can be sequentially coated with thin layered components of the insulator described, as required, by known means, or microfluidically continuously cast using the principles taught above.

While illustrative embodiments have been illustrated and described, it will be appreciated that various changes can be made therein without departing from the spirit and scope of the invention.

The embodiments of the invention in which an exclusive property or privilege is claimed are defined as follows:

1. A lightweight composite electrical wire, comprising:

at least one electrically conductive core portion comprising an alkali metal; and an electrically conductive wall surrounding the at least one core portion;

wherein the at least one core portion is adapted to repeatedly melt and refreeze during normal operation of the composite conductor;

wherein the electrically conductive wall is a composite wall comprising at least a first wall component and a second wall component, the first and second wall components having different coefficients of thermal expansion;

wherein the first wall component is joined to the second wall component such that changing the temperature of the first and second wall components causes elastic stresses in the composite wall; and wherein the composite wall is curved, and further wherein heating the curved composite wall above room temperature will urge the curved composite walls toward a profile increasing the volume available for the alkali metal core portion.

2. The lightweight composite electrical wire of claim 1, wherein the conductive core portion comprises sodium and the wall comprises aluminum, the wire further comprising a plurality of longitudinally spaced transverse bulkheads that separate the at least one core portion into a plurality of non-contiguous core cells.

3. The lightweight composite electrical wire of claim 2, further comprising an intermediate layer disposed between the core cells and the conductive wall, the intermediate layer comprising at least one of copper, lithium and molybdenum.

4. The lightweight composite electrical wire of claim 2, wherein the composite conductor comprises a wire having a reduced thickness at the bulkheads.

5. A lightweight wire for conducting electricity, the wire comprising a multi-channel microtubular composite conductor having a plurality of fusible alkali metal fusible core elements that are encased by conductive walls that define an array of microtubular channels that are filled by the fusible core elements and wherein the conductive walls are composite walls comprising at least a first wall component and a second wall component, the first and second wall components having different coefficients of thermal expansion;

wherein the first wall component is joined to the second wall component such that changing the temperature of the first and second wall components causes elastic stresses in the composite walls; and wherein the composite walls are curved, and further wherein heating the curved composite walls above room temperature will urge the curved composite walls toward a flatter profile, thereby increasing the volume available for the sodium core elements.

6. The lightweight wire of claim 5, wherein the composite walls define a re-entrant structure.

7. The lightweight wire of claim 5, wherein one of the first and second wall components comprise a copper alloy.

8. The lightweight wire of claim 5, wherein one of the first and second wall components comprise an alloy of iron.

9. The lightweight wire of claim 5, wherein the plurality of fusible core elements are formed of one of sodium and a sodium alloy.

10. The lightweight wire of claim 9, wherein one of the first and second wall components comprises an alloy of iron, and the other of the first and second wall components comprises a copper alloy.

11. The lightweight wire of claim 5, further comprising a plurality of transverse bulkheads that separate the fusible core elements into a plurality of longitudinally spaced sections, the bulkheads comprising copper embedded in solder.

12. The lightweight wire of claim 11, wherein at least some of the copper is filamentous with filaments generally aligned with a longitudinal axis of the wire.

13. The lightweight wire of claim 11, wherein the bulkheads further comprise at least one layer comprising at least one of magnesium, aluminum and copper.

14. The lightweight wire of claim 11, wherein the bulkheads define indentations such that the tensile strength of the wire is lower at the bulkheads than away from the bulkheads.

15. The lightweight wire of claim 5, further comprising an outer insulating layer comprises a plurality of septa and define a plurality of channels between the outer layer and the conductive walls, and further comprising a fusible material disposed in at least some of the plurality of channels.

* * * * *

UNITED STATES PATENT AND TRADEMARK OFFICE

CERTIFICATE OF CORRECTION

PATENT NO. : 7,626,122 B2
APPLICATION NO. : 11/845716
DATED : December 1, 2009
INVENTOR(S) : D. Levine It is certified that error appears in the above-identified patent and that said Letters Patent is hereby corrected as shown below:

| COLUMN | LINE | ERROR |
|---|---|---|
| 22 (Claim 1, | 10 line 8) | "conductor;" should read --wire;-- |
| 22 (Claim 4, | 37 line 2) | "conductor" should read --wire-- |
| 22 (Claim 5, | 41 line 3) | "metal fusible core" should read --metal core-- |
| 22 (Claim 5, | 57 line 18) | "sodium core" should read --alkali metal core-- |

Signed and Sealed this

Sixth Day of April, 2010

David J. Kappos

David J. Kappos
*Director of the United States Patent and Trademark Office*